United States Patent [19]

Sano et al.

[11] Patent Number: 4,983,905

[45] Date of Patent: Jan. 8, 1991

[54] CONSTANT VOLTAGE SOURCE CIRCUIT

[75] Inventors: Yoshiaki Sano, Yokohama; Toshio Hanazawa; Yasuhide Katagase, both of Kasugai; Katsuyuki Yasukouchi, Seto; Takashi Matsumoto, Inazawa, all of Japan; Susumu Fujihara, Torrance, Calif.

[73] Assignees: Fujitsu Limited, Kawasaki; Fujitsu VLSI Limited, Kasugai; Fujitsu Ten Limited, Kobe, all of Japan

[21] Appl. No.: 375,707

[22] Filed: Jul. 5, 1989

[30] Foreign Application Priority Data

Jul. 5, 1988 [JP] Japan ..... 63-167939
Jul. 5, 1988 [JP] Japan ..... 63-167940

[51] Int. Cl.[5] ..... G05F 1/56

[52] U.S. Cl. ..... 323/274; 323/275; 323/281; 323/303

[58] Field of Search ..... 323/274, 275, 281, 299, 323/303

[56] References Cited

U.S. PATENT DOCUMENTS 3,939,399 2/1976 Funatsu et al. ..... 323/303
4,319,179 3/1982 Jett, Jr. ..... 323/281
4,327,319 4/1982 Swisher et al. ..... 323/303
4,771,226 9/1988 Jones ..... 323/303
4,814,687 3/1989 Walker ..... 323/303

FOREIGN PATENT DOCUMENTS 58-154019 9/1983 Japan .
62-22125 1/1987 Japan .
62-114014 5/1987 Japan .
62-295126 12/1987 Japan .

*Primary Examiner*—Peter S. Wong
*Attorney, Agent, or Firm*—Staas & Halsey

[57] ABSTRACT

A constant voltage source circuit which is provided with an output transistor ($Q_1$) for outputting a predetermined output voltage ($V_0$) in accordance with an input voltage ($V_{IN}$) and a differential amplifier (A), and is further characterized in that the circuit further comprises a reference voltage control means which monitors variations of the input voltage ($V_{IN}$) and outputs a predetermined constant voltage to the differential amplifier (A) as a reference voltage when the input voltage ($V_{IN}$) is higher than, a predetermined voltage level, and a voltage varied in accordance with the variation of the input voltage ($V_{IN}$) is output therefrom to the differential amplifier (A) as a reference voltage when the input voltage ($V_{IN}$) falls below a predetermined voltage level.

15 Claims, 7 Drawing Sheets

CONSTANT VOLTAGE SOURCE CIRCUIT

BACKGROUND OF THE INVENTION

1. Field of the Invention

This invention relates to a constant voltage source circuit to be used in an audio system or the like.

2. Description of the related Art

Many of devices operate on a supply of a constant voltage, for example, an audio system provided in an automobile and supplied with power by a car battery is typical of such devices. In this kind of device, the constant voltage source circuit supplying the electric power thereto must operate stably at an input voltage maintained at a predetermined voltage level. Sometimes, however, the voltage input to the constant voltage source circuit will fall below the predetermined level when for example, the voltage of the car battery is lowered but nevertheless the operating conditions of the audio system connected to the car battery must be kept stable.

Namely, the characteristics thereof such as ripple rejection or the like, must not be affected even when the output voltage thereof is lowered in accordance with the lowering of the voltage input to the constant voltage source circuit.

FIG. 5 shows an example of a conventional constant voltage source circuit.

In the conventional constant voltage source circuit shown in FIG. 5, when an input voltage $V_{IN}$ is higher than a predetermined voltage level $V_{IN(S)}$, i.e., when the constant voltage source circuit is in a stable condition, the constant voltage source circuit supplies a constant voltage in such a manner that both a voltage obtained by dividing the output voltage $V_O$ with resistors $R_1$ and $R_2$ and a reference voltage $V_{REF}$ are input to a differential amplifier A, and the output of the differential amplifier A is fed back to an output transistor $Q_1$.

In the conventional constant voltage source circuit shown in FIG. 5, however, when the input voltage $V_{IN}$ falls below the predetermined voltage level $V_{IN(S)}$, i.e., when the constant voltage source circuit is no in a stable condition, the circuit does not include a means for overcoming the problems caused thereby and therefore, an output voltage $V_O$ which is nearly the same as the input voltage $V_{IN}$ is output therefrom, as shown in FIG. 6.

A further problem arises in that when the constant voltage source circuit is not in a stable condition, the output transistor $Q_1$ is saturated and thus the ripple rejection characteristic is adversely affected.

FIG. 7 shows an example in which the conventional constant voltage source circuit shown in FIG. 5 is applied to a conventional audio system.

In this example, when the input voltage $V_{IN}$ is lowered and the operation of the constant voltage source circuit is not in a stable condition, the ripple component will appear in the voltage ($V_O$) output by the constant voltage source circuit.

Further, the ripple rejection of a small signal amplifier As connected to the output of the constant voltage source circuit is also adversely affected by the lowering of the input voltage, and thus a problem arises in that the input voltage is oscillated while input to a power amplifier through the small signal amplifier As.

Therefore, when the input voltage $V_{IN}$ is lowered and the operation of the constant voltage source circuit is not in a stable condition, the above problems are conventionally overcome by immediately turning OFF the constant voltage source circuit.

But, when the constant voltage source circuit is used in an audio system, this interrupts the broadcast sound and is irritating to the listener.

FIG. 8 shows another example of the conventional constant voltage source circuit.

As shown in the figure, when this circuit operates in such an unstabilized area, the ripple components accumulated in the input voltage $V_{IN}$, are eliminated by using a ripple filter composes of a resistor $R_8$ and a condenser $C_2$.

Accordingly, in this example, the ripple rejection characteristic is improved but, since this circuit includes a Zener diode ZD and does not have a feedback system, it is difficult to maintain the performance of this circuit at a predetermined level when in a stable condition, due to the characteristic variation of the Zener diode ZD.

The problem to be overcome is that when the constant voltage source circuit has a construction such that a large stress is imposed on the operating characteristics of the circuit when the circuit is in a stable condition, the ripple rejection will be adversely affected when the operating condition thereof is not in a stable condition. Conversely, when the constant voltage source circuit has a circuit construction such that a large stress is imposed on the ripple rejection thereof when the circuit is not in a stable condition, the operating characteristics of the constant voltage circuit when in the stable condition will be lowered.

To overcome the drawbacks mentioned above, several methods have been proposed in for example, Japanese Unexamined Pat. Publications No. 58-154019, No. 62-114014, No. 62-22125 and No. 62-295126.

Each of these publications, discloses a constant voltage source circuit in which a transfer of noise in the input voltage to the output voltage is prevented by avoiding a saturation of an output transistor by controlling that the base voltage of the output transistor when the output voltage falls below a predetermined level, by monitoring the voltage output by the circuit.

In each of these publications, the control is effected by detecting the voltage output by the output terminal of the circuit, and accordingly, many IC circuits usually must be provided downstream of the output terminal of the circuit.

Therefore, when a large load is applied to the output terminal, a long time is required to stabilize the output voltage at the rise time thereof i.e., the rise time of the output voltage is prolonged.

Further in these prior arts, since the control of the output transistor is effected by detecting this prolonged rise time of the output voltage, the circuit is apt to define this as a condition in which the output transistor is approaching saturation, and thus reduce the output by the output transistor to prevent this saturation.

SUMMARY OF THE INVENTION

The object of this invention is to provide a constant voltage source circuit in which the characteristics thereof during a stable operation thereof are superior and characteristics of the ripple rejection thereof are also superior even when the input voltage is lowered and the operating condition is not stable.

Therefore, according to the present invention, there is provided a constant voltage source circuit which comprises an output transistor ($Q_1$) for outputting a predetermined output voltage ($V_0$) in accordance with an input voltage ($V_{IN}$), and a differential amplifier (A). The constant voltage source circuit further comprises a reference voltage control means which, by monitoring variations of the input voltage ($V_{IN}$), outputs a predetermined constant voltage to the differential amplifier (A) as a reference voltage when the input voltage ($V_{IN}$)is higher than a predetermined voltage level, and outputs a voltage varied in accordance with the variations of the input voltage ($V_{IN}$) to the differential amplifier (A) as a reference voltage when the input voltage ($V_{IN}$) falls below the predetermined voltage level.

According to the present invention, the circuit is constructed in such a way that, to avoid a saturation of the output transistor ($Q_1$) when an input voltage ($V_{IN}$) is lower than a predetermined level, i.e., is not stable, an emitter-collector voltage $V_{EC}$ of the output transistor ($Q_1$) is formed to provide a differential voltage $V_a$ between the input voltage $V_{IN}$ and the output voltage $V_0$. Consequently, in the present invention, the reference voltage control means supplies a reference voltage $V_{REF}$ to the differential amplifier (A) to create the voltage $V_{CE}$.

Further, in the present invention, the condition of the reference voltage $V_{REF}$ to be applied to the differential amplifier (A) used when the input voltage ($V_{IN}$) is higher than the predetermined voltage $V_{IN(S)}$, and the condition of the reference voltage $V_{REF}$ when the input voltage ($V_{IN}$) is lower than the predetermined voltage $V_{IN(S)}$, are different. In the former case, the reference voltage $V_{REF}$ to be supplied to the differential amplifier (A) is a predetermined constant voltage, and in the latter case, the reference voltage $V_{REF}$ to be supplied to the differential amplifier (A) is varied in accordance with variations in the input voltage ($V_{IN}$).

Namely, in the present invention, to create the voltage $V_{CE}$, i.e., a differential voltage $V_a$ at the output transistor ($Q_1$) and thus avoid a saturation thereof, the reference voltage control is effected by monitoring the input voltage ($V_{IN}$) and the condition of the reference voltage $V_{REF}$ to be supplied to the differential amplifier (A), as explained above, is alternatively switched by the detected input voltage ($V_{IN}$) with respect to the $V_{IN(S)}$ as a threshold value.

Note that, in the present invention as explained above, the reference voltage supplied to the differential amplifier A is not constant but is varied in accordance with variation in the input voltage ($V_{IN}$), for example, is lowered to a predetermined level in accordance with the lowering of the input voltage ($V_{IN}$).

Accordingly, saturation of the output transistor ($Q_1$) can be avoided because the output voltage ($V_0$) is lowered as the input voltage ($V_{IN}$) is lowered, and therefore, variations of the input voltage ($V_{IN}$) are not transferred to the output voltage ($V_0$) through the output transistor ($Q_1$). Also, in the present invention, since the control of the output voltage is effected by detecting only the input voltage ($V_{IN}$), the problem of a prolonging of the rise time of the output voltage, as in the conventional method, does not arise.

DESCRIPTION OF THE PREFERRED EMBODIMENTS

The preferred embodiments of this invention will be described hereunder with reference to the attached drawings.

Figure 1:
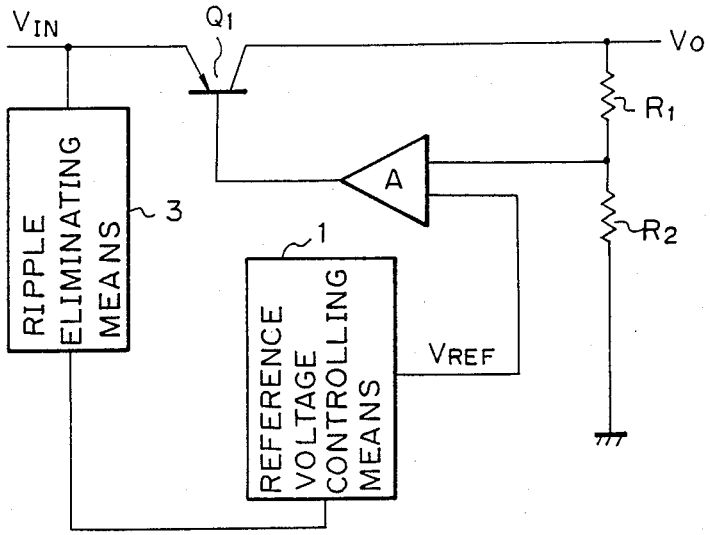
FIG. 1 a block diagram showing the basic construction of the constant voltage source circuit of the present invention.

FIG. 1 is a schematic diagram of the basic construction of the constant voltage source circuit of the present invention.

As shown in FIG. 1, the constant voltage source circuit of this invention comprises an output transistor $Q_1$ for outputting a predetermined output voltage $V_0$ in accordance with an input voltage $V_{IN}$, a differential amplifier A having an output connected to the base of the output transistor $Q_1$, a reference voltage control means 1 having an input connected to the input terminal portion of the constant voltage source circuit and an output connected to one of the input terminals of the differential amplifier A, and a ripple elimination means 3 inserted in the line connecting the input terminal of the constant voltage source circuit and the input terminal of the reference voltage control means.

Further, a voltage obtained by dividing the output voltage $V_0$ with the resistors $R_1$ and $R_2$ is input to another input terminal of the differential amplifier A.

The reference voltage control means 1 of the present invention constantly monitors variations of the input voltage ($V_{IN}$) and outputs a predetermined constant voltage to the differential amplifier (A) as a reference voltage when it is determined that the input voltage ($V_{IN}$) is higher than a predetermined voltage level, and outputs a varied voltage corresponding to the variation of the input voltage ($V_{IN}$) to the differential amplifier (A) as a reference voltage when it is determined that the input voltage ($V_{IN}$) is lower than the predetermined voltage level.

In the present invention, the output of the reference voltage control means is preferably connected to the inverting input terminal of the differential amplifier A, and a voltage corresponding to the variations of the input voltage $V_{IN}$ is output to the base of the output transistor ($Q_1$).

Figure 3:
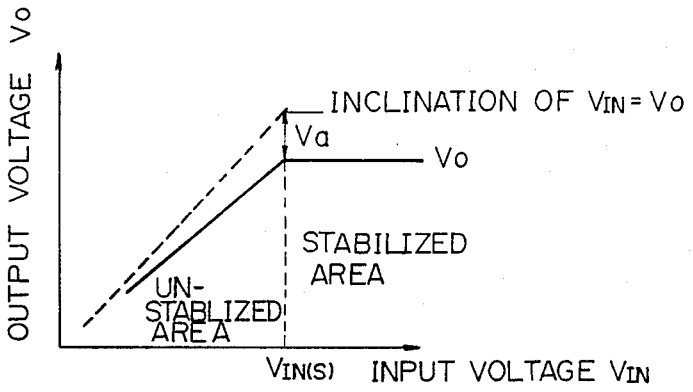
FIG. 3 is a chart showing the characteristics of the constant voltage source circuit shown in FIG. 2A.

Note that, in the present invention, when the input voltage ($V_{IN}$)is in a stable condition in which the input voltage ($V_{IN}$) is higher than a predetermined level $V_{IN(S)}$, shown in FIG. 3 as an area indicated by $V_{IN} \geqq V_{IN(S)}$, a constant reference voltage $V_{REF}$ is supplied to the base of the output transistor ($Q_1$) through the differential amplifier A. On the other hand, when the input voltage $V_{IN}$ is not in a stable condition, in which the input voltage $V_{IN}$ is lower than the predetermined level $V_{IN(S)}$ shown in FIG. 3 as an area indicated by $V_{IN} \leqq V_{IN(S)}$, a reference voltage $V_{REF}$ varied in accordance with a variation of the input voltage $V_{IN}$ is supplied to the base of the output transistor ($Q_1$) through the differential amplifier A and a voltage $V_0$ corresponding to the variation of the input voltage $V_{IN}$ is output to avoid a saturation of the output transistor ($Q_1$) and the differential amplifier A.

Hereinafter, the differential amplifier A is called the error amplifier (A).

Note, the ripple component accumulated in the input voltage $V_{IN}$ is eliminated by the ripple elimination means.

A preferred embodiment of the present invention will be described in more detail with reference to FIGS. 2A and 2B and FIG. 4.

Figure 2A:
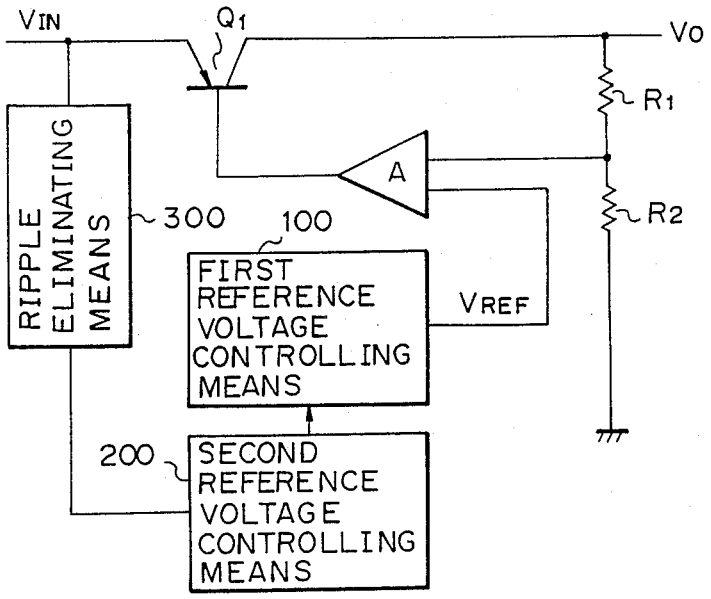
FIG. 2A is a block diagram showing a first embodiment of the present invention.
Figure 2B:
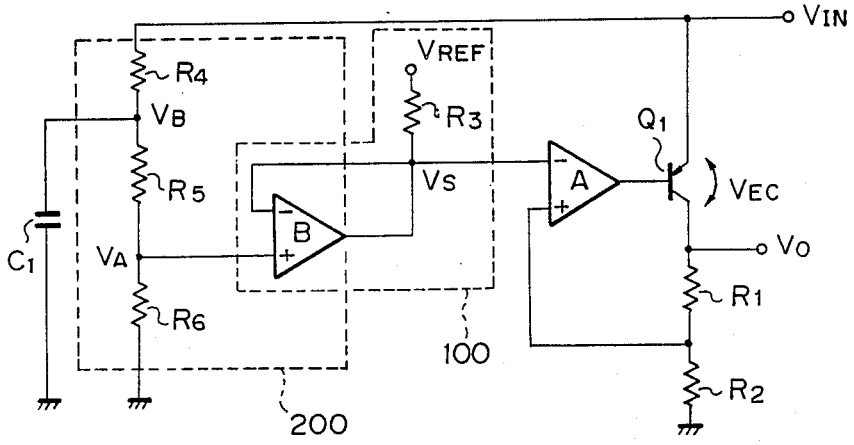
FIG. 2B is a detailed circuit diagram of the configuration of the embodiment shown in FIG. 2A.

FIG. 2A is a block diagram of a circuit of a first embodiment of the constant voltage source circuit of the present invention, and FIG. 2B is a circuit diagram of the embodiment of the constant voltage source circuit shown in FIG. 2A.

The buffer amplifier B (explained later) and the resistor $R_3$ comprise the first reference voltage control means 100, and the buffer amplifier B and the resistors $R_4$, $R_5$ and $R_6$ comprise the second reference voltage control means 200.

Figure 4:
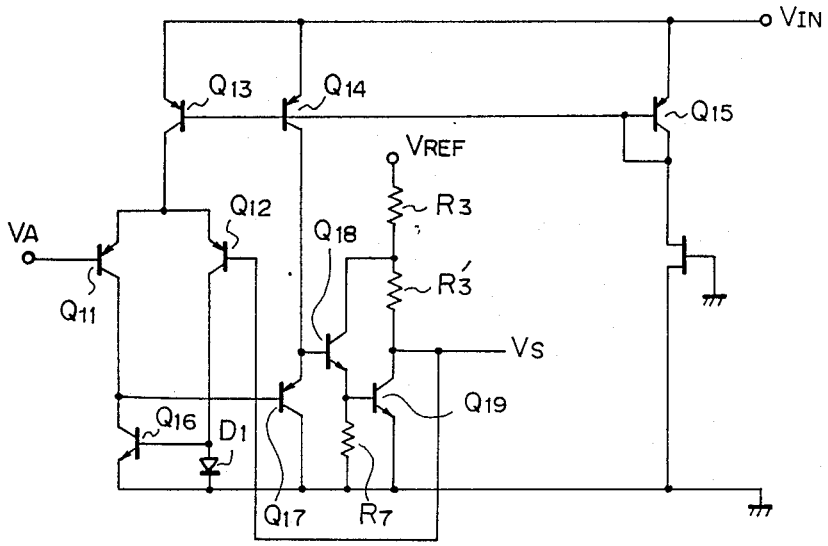
FIG. 4 is a circuit detailed diagram of the configuration of an embodiment of the buffer amplifier used in the circuit shown in FIG. 2B.

FIG. 4 is a circuit diagram of the buffer amplifier B shown in FIG. 2B.

In accordance with this embodiment, as shown in FIG. 2A, the reference voltage control means 1 comprises a first reference voltage control means 100 for supplying a predetermined reference voltage $V_{REF}$ to the differential amplifier A when the input voltage ($V_{IN}$) is higher than the predetermined voltage level $V_{IN(S)}$, and a second reference voltage control means 200 for supplying an output voltage corresponding to the variation of the input voltage ($V_{IN}$) to the first reference voltage control means 100, to output a varied reference voltage $V_{REF}$ corresponding to the variation of the input voltage $F(V_{IN})$ to the differential amplifier A when the input voltage ($V_{IN}$) is lower than the predetermined voltage level.

Note, the remaining components shown in FIG. 2A are the same as those shown in FIG. 1.

FIG. 2B is a detailed circuit diagram of the circuit shown in FIG. 2A above, in which the output terminal of the differential amplifier A is connected to the base of the output transistor ($Q_1$) and the emitter of the output transistor ($Q_1$) is connected to an input voltage source ($V_{IN}$) and the output is taken from the collector of the output transistor ($Q_1$). Further, a resistor $R_1$ and a resistor $R_2$ are serially connected between the collector of the output transistor means ($Q_1$) and a ground (GND), and the resistors $R_1$ and $R_2$ are connected to a noninverting input terminal of the differential amplifier A.

Figure 5:
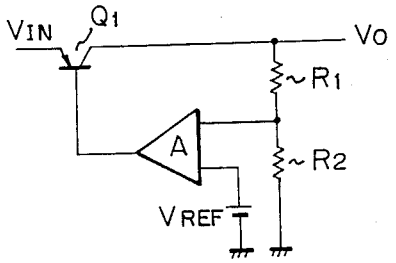
Fig. 5 (PRIOR ART)
FIG. 5 is a circuit diagram of an example of a conventional constant voltage source circuit.
Figure 6:
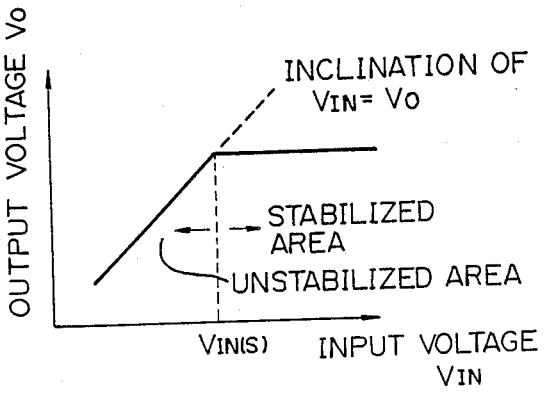
Fig. 6 (PRIOR ART)
FIG. 6 chart showing the characteristics of the input voltage ($V_{IN}$) versus output voltage ($V_0$) in the circuit shown in FIG. 5.
Figure 7:
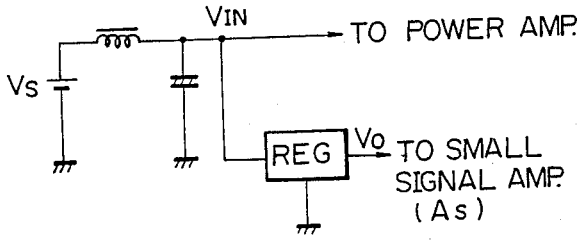
Fig. 7 (PRIOR ART)
FIG. 7 is a circuit diagram of a conventional audio system in which the constant voltage source circuit shown in FIG. 5 is applied to the voltage source thereof.
Figure 8:
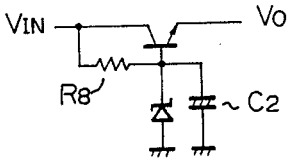
Fig. 8 (PRIOR ART)
FIG. 8 is a circuit diagram of another example of a conventional constant voltage source circuit.

The construction of the embodiment as explained above is the same as the construction of the conventional constant voltage source circuit shown in FIG. 5, except for the following differences.

In the conventional constant voltage source circuit as shown in FIG. 5, the noninverting input terminal is connected to a constant reference voltage source ($V_{REF}$) and the output voltage ($V_0$) is determined by the feedback ratio defined by the resistors $R_1$ and $R_2$ and the reference voltage $V_{REF}$.

In this embodiment, however the inverting input terminal of the differential amplifier A is connected to the output of a buffer amplifier B, to control the reference voltage, and further, a voltage $V_A$ is obtained from the input voltage ($V_{IN}$) by dividing the input voltage ($V_{IN}$) with an array of resistors $R_4$, $R_5$, and $R_6$ provided between the input voltage source ($V_{IN}$) and the earth (GND), and a constant reference voltage source ($V_{REF}$) is connected to the noninverting input terminal of the buffer amplifier B through the resistor $R_3$.

A ripple elimination circuit 300 comprises the resistor $R_4$ and a capacitor $C_1$ having a terminal connected to the resistors $R_4$ and $R_5$ and another terminal connected to the earth. The resistors $R_4$, $R_5$ $R_6$ and the buffer amplifier B cooperate to generate the voltage $V_a$, as shown in FIG. 3, in the output transistor ($Q_1$).

When the voltage $V_A$ supplied to the noninverting input terminal of the buffer amplifier B is lower than the reference voltage $V_{REF}$ ($V_A < V_{REF}$), the output $V_s$ of the buffer amplifier B is equal to the voltage $V_A$ ($V_{S=VA}$), and when the volta $V_A$ supplied to the noninverting input terminal of the buffer amplifier B is higher than the reference voltage $V_{REF}$ ($V_A \geqq V_{REF}$), the output $V_s$ of the buffer amplifier B is equal to the reference voltage $V_A$ of the reference voltage source.

By defining the area of the input voltage ($V_{IN}$) in which the condition $V_A < V_{REF}$ is realized as the area below $V_{IN(S)}$, as shown in FIG. 3, the voltage $V_a$ is generated at the output transistor ($Q_1$) to prevent a saturation thereof, while taking the condition $V_A = V_S < V_{REF}$ into account.

Further, the ripple filter comprising the resistor $R_4$ and the capacitor $C_1$ eliminates the ripple component accumulated in the input voltage ($V_{IN}$), and therefore, only direct current voltage is supplied to the noninverting input terminal of the buffer amplifier B.

FIG. 4 shows a specific embodiment of the buffer amplifier B used in the present invention.

In FIG. 4, the emitters of the transistors $Q_{11}$ and $Q_{12}$ are commonly connected to each other, and the common by contacted terminal portion is connected to a collector of the transistor $Q_{13}$ forming a constant electric current source circuit in association with the transistors and $Q_{14}$ and $Q_{15}$.

Further, a voltage $V_A$ obtained from the input voltage ($V_{IN}$) by dividing the input voltage ($V_{IN}$) with an array of the resistors $R_4$, $R_5$ and $R_6$ is supplied to the base of the transistor $Q_{11}$, and the collector of the transistor $Q_{11}$ is connected to the earth through a transistor $Q_{16}$. Also the base of the transistor $Q_{12}$ is connected to the reference voltage $V_{REF}$ source through the resistors $R_3$ and $R_3'$.

The collector of the transistor $Q_{12}$ and the base of the transistor are connected to a cathode of a diode $D_1$, and the anode of the diode $D_1$ is connected to the earth. The collector of the transistor $Q_{14}$ is connected to a base of a transistor $Q_{18}$ and simultaneously, is connected to an emitter of a transistor $Q_{17}$. Further, the collector of the transistor $Q_{18}$ is connected to the resistors $R_3$ and $R_3'$, and the emitter of the transistor $Q_{18}$ is connected to the base of a transistor $Q_{19}$ and simultaneously, connected to the earth through a resistor $R_7$.

Finally, the collector of the transistor $Q_{19}$ is connected to one end of the resistor $R_3'$ and simultaneously, connected to the base of the transistors $Q_{12}$.

The operation of this circuit will be explained hereunder.

In this circuit, the voltage $V_A$ obtained from the input voltage ($V_{IN}$) by dividing the input voltage ($V_{IN}$) with an array of the resistors $R_4$, $R_5$ and $R_6$ is set at a higher voltage than the reference voltage ($V_{REF}$) when the input voltage ($V_{IN}$) is high in the stable condition, whereby the transistor $Q_{11}$ is made OFF. Therefore, the collector voltage of the transistor $Q_{11}$ is reduced and an electrical current I is made to flow into the transistor $Q_{17}$, since the transistor $Q_{17}$ is ON. Simultaneously, the transistors $Q_{19}$ and $Q_{18}$ are made OFF.

At this time, since the transistor $Q_{12}$ is ON, a small amount of current is made to flow into the reference voltage ($V_{REF}$) through the base of the transistor $Q_{12}$, whereby a voltage $V_s$ which is equal to the reference voltage $V_{REF}$ is supplied to the noninverting input terminal of the differential amplifier A.

In this case, since the transistors $Q_{19}$ and $Q_{18}$ are OFF, the level of $V_{REF}$ appears directly at $V_s$ and is supplied to the differential amplifier A.

Further, when the voltage $V_A$ is lower than the voltage $V_{REF}$ of the reference voltage source, and the operation thereof becomes unstable, the collector voltage of the transistor $Q_{11}$ is increased and the transistor $Q_{17}$ is made OFF, and simultaneously, the transistors $Q_{18}$ and $Q_{19}$ are made ON. Accordingly, the electric current I is made to flow from the $V_{REF}$ to the transistor $Q_{19}$, and thus the voltage $V_s$ is represented by the equation $[V_{REF}-I\cdot(R_3+R_3')]$.

In this condition, the gain of the buffer amplifier B is 1, and thus the voltage $V_s$ is equal to the voltage $V_A$.

Accordingly, in this embodiment, the $V_s$, having a voltage corresponding to the variation of the voltage $V_A$ is output.

In the operating time of this circuit in the stable condition ($V_{IN} \leqq V_{IN(S)}$), the following equations are established.

$$V_0 = \frac{R_1 + R_2}{R_2} \times V_s \quad (1)$$

$$V_A = \frac{R_6}{R_4 + R_5 - R_6} \times V_{IN} \quad (2)$$

Accordingly, the output voltage $V_0$ is represented by the following equation;

$$V_0 = \frac{R_6 \times (R_1 + R_2)}{(R_4 + R_5 + R_6) \times R_2} \times V_{IN} \quad (3)$$

To simplify the equation (3), by introducing conditions such as $R_5=R_1$, and $R_6=R_2$ therein, it can be expressed as the following equation (4)

$$V_0 = \frac{R_1 + R_2}{R_4 + R_1 + R_2} \times V_{IN} \quad (4)$$

Accordingly, the difference of the voltage of the input voltage and the output voltage $V_a$ can be determined only by the resistor $R_4$ when $V_{IN}=V_{IN(S)}$ and the values of the other resistors $R_1$ and $R_2$ are constant.

Therefore, even when the input voltage ($V_{IN}$) is low and the circuit operates in the unstable condition, the collecter-emitter voltage, $V_{CE}$ of the output transistor means ($Q_1$) is usually held to avoid a saturation thereof, and accordingly, an adverse affect on the ripple rejection of the output transistor ($Q_1$) caused by the saturation thereof at the low voltage is minimized.

Nevertheless since equation (4) includes the factor of $V_{IN}$, when a ripple is accumulated in the factor of $V_{IN}$, the ripple must appear in the output voltage $V_0$.

To avoid this problem, the ripple filter comprising the resistor $R_4$ and the capacitor $C_1$ is provided so that only a direct current is supplied to the noninverting input terminal of the buffer amplifier B, whereby an adverse affect on the ripple rejection is avoided.

Note, that, according to the constant voltage source circuit of the present invention, when the input voltage ($V_{IN}$) is higher than a predetermined level $V_{IN(S)}$ shown in FIG. 3 as an area indicated by $V_{IN} \geqq V_{IN(S)}$, a constant reference voltage $V_{REF}$ is supplied the base of the differential amplifier A from a first reference voltage supply means 100, which outputs an output voltage having a constant voltage defined by the feedback ratio determined by the reference voltage $V_{REF}$ and resistors $R_1$ and $R_2$, to the base of the transistor ($Q_1$).

Further when the input voltage $V_{IN}$ is lowered and becomes unstable, i.e., the input voltage $V_{IN}$ falls below the predetermined level $V_{IN(S)}$ shown in FIG. 3 as an area indicated by $V_{IN} \leqq V_{IN(S)}$, a reference voltage $V_{REF}$ varied in correspondence to the variation of the input voltage $V_{IN}$ is supplied to the differential amplifier A to output an output voltage corresponding to the variation of the input voltage $V_{IN}$ to the base of the output transistor ($Q_1$), to avoid a saturation thereof.

The ripple component accumulated in the input voltage $V_{IN}$ is eliminated by the ripple elimination means.

A second embodiment of the constant voltage source circuit of this invention will be described with reference to FIGS. 9 to 11.

Figure 9A:
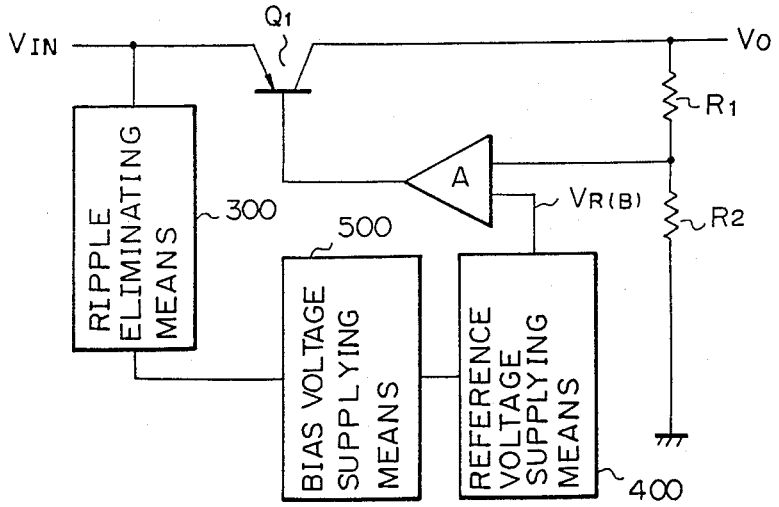
FIG. 9A is a block diagram showing a second embodiment of the present invention.
Figure 10:
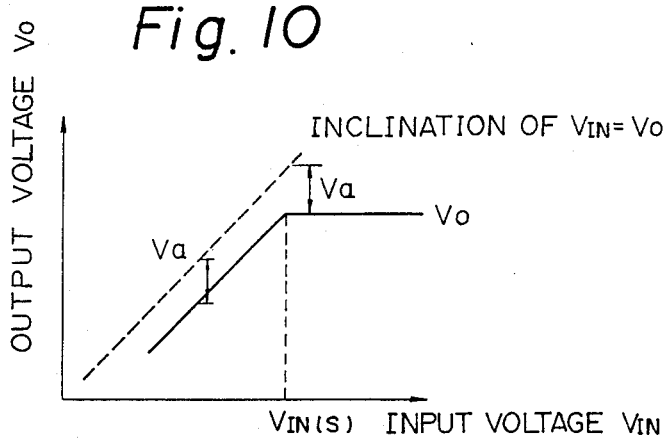
FIG. 10 is a chart showing the characteristics of the constant voltage source circuit shown in FIG. 9A.

FIG. 9A shows a block diagram of the second embodiment, in which the reference voltage control means 1 used in this embodiment comprises a reference voltage supply means 400 for supplying a reference voltage having a predetermined constant voltage to the differential amplifier (A) when the input voltage ($V_{IN}$) is higher than a predetermined voltage level, and a bias voltage supply means 500 for supplying a bias voltage varied in correspondence to the variation of the input voltage ($V_{IN}$), to the reference voltage supply means 400 to provide a reference voltage ($V_{RB}$) varied in accordance with the variation of the bias voltage to the differential amplifier (A), when the input voltage ($V_{IN}$) falls below the predetermined voltage level, whereby the output voltage ($V_0$) having the relationship to the input voltage ($V_{IN}$) shown in FIG. 10 providing a difference of voltage $V_a$ therebetween, is output from the output transistor ($Q_1$) to avoid a saturation thereof.

Note, all other components shown in FIG. 9A are the same as those shown in FIG. 1.

According to this embodiment, when the input voltage $V_{IN}$ is not stable i.e., the input voltage $V_{IN}$ is lower than the predetermined level $V_{IN(S)}$ ($V_{IN} \leqq V_{IN(S)}$ as shown in FIG. 10), the bias voltage output from the bias voltage supplying means 500, to the reference voltage supply means 400 is varied in accordance with the variation of the input voltage ($V_{IN}$), to prevent a saturation of the output transistor ($Q_1$) and the differential amplifier A, and thus the reference voltage ($V_{REF}$) input to the differential amplifier A is varied in accordance with the variation of the input voltage ($V_{IN}$).

As in the previous embodiment, the ripple component accumulated in the input voltage $V_{IN}$ is eliminated by the ripple elimination means.

Figure 9B:
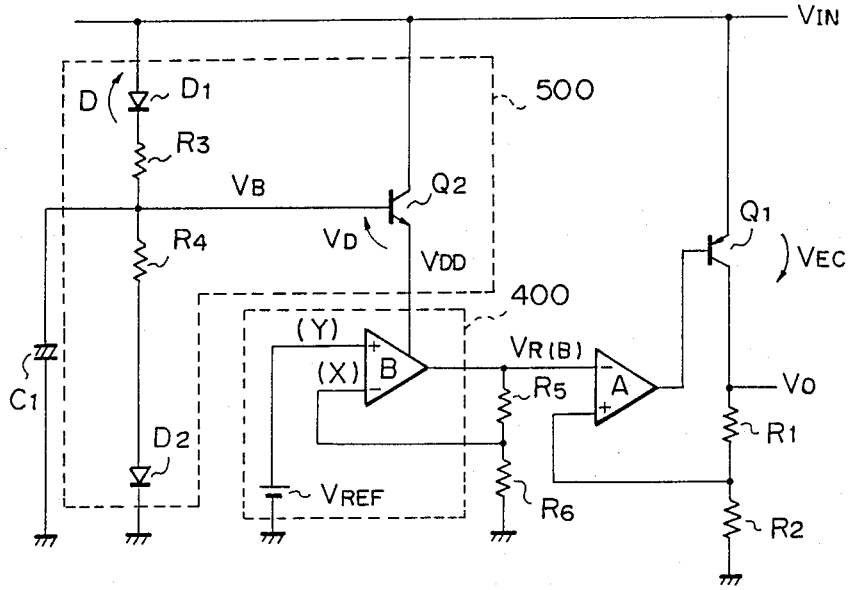
FIG. 9B is a detailed circuit diagram of the configuration of the embodiment shown in FIG. 9A.

FIG. 9B shows a detailed circuit diagram of this embodiment, corresponding to the block diagram shown in FIG. 9*a*.

In FIG. 9B, the bias voltage supply means 500 comprises a transistor $Q_2$, diodes $D_1$ and $D_2$, and resistors $R_3$ and $R_4$, wherein the diode $D_1$, the resistors $R_3$ and $R_4$ and the diode $D_2$ are connected between the input voltage source ($V_{IN}$) and the earth in that order. The resistors $R_3$ and $R_4$ are also connected to the base of the transistor $Q_2$, and the collector of the transistor $Q_2$ is connected to the input voltage source ($V_{IN}$) and the emitter thereof is connected to the bias terminal of the buffer amplifier, explained later.

The reference voltage $V_{REF}$ is supplied to the noninverting input terminal (Y) of the buffer amplifier B, and the voltage obtained by dividing the output of the buffer amplifier B with the array of the resistors $R_5$ and $R_6$ is feedback to the inverting input terminal (X).

This buffer amplifier B uses the reference voltage supply means 500 to provide a reference voltage ($V_{RE}$) to the differential amplifier A.

A ripple filter circuit 300 is composed of the resistor $R_3$ and a capacitor $C_1$ having one terminal connected to the resistors $R_4$ and $R_3$ and the remaining terminals connected to the earth. According to this embodiment, the characteristic chart of the input voltage ($V_{IN}$) and the output voltage ($V_0$) of this constant voltage source circuit as shown in FIG. 10 is obtained.

Note, in this embodiment, when the input voltage ($V_{IN}$) is higher than a predetermined level $V_{IN(S)}$ shown in FIG. 10 as an area indicated by $V_{IN} \geqq V_{IN(S)}$, i.e., the input voltage ($V_{IN}$) is stable, a constant voltage $V_0$ determined by a reference voltage ($V_{RB}$) and the resistance value of the feedback resistor $R_1$ and $R_2$ is output regardless of the level of the input voltage ($V_{IN}$).

Conversely, when the input voltage $V_{IN}$ is lower than the predetermined level $V_{IN(S)}$ i e., $V_{IN} \leqq V_{IN(S)}$ and the input voltage ($V_{IN}$) is not stable, the output voltage ($V_0$) having a voltage lower than the input voltage ($V_{IN}$) by a predetermined value of the voltage $V_a$, is always output from the output thereof.

To obtain the characteristics as mentioned above, when the input voltage ($V_{IN}$) is higher than a predetermined level $V_{IN(S)}$ ($V_{IN} \geqq V_{IN(S)}$), the reference voltage ($V_{RB}$) input to the differential amplifier A is determined by the reference voltage $V_{REF}$) and the resistance value of the feedback resistor $R_5$ and $R_6$ Therefore, the output voltage ($V_0$) is determined by the reference voltage ($V_{RB}$) supplied to the noninverting input terminal of the differential amplifier and the resistance value of the feedback resistors $R_1$ and $R_2$, to output a constant voltage therefrom.

Namely, the reference voltage ($V_{RB}$) applied to the differential amplifier A is determined by the following equation.

$$V_{RB} = \frac{R_5 + R_6}{R_6} \times V_{REF} \tag{5}$$

and the output voltage ($V_0$) is represented by the following equation.

$$\begin{aligned} V_0 &= \frac{R_1 + R_2}{R_2} \times V_{RB} \\ &= \frac{R_1 + R_2}{R_2} \times \frac{R_5 + R_6}{R_6} \times V_{REF} \end{aligned} \tag{6}$$

When the input voltage $V_{IN}$ is lower than the predetermined level $V_{IN(S)}$ i.e., $V_{IN} \leqq V_{IN(S)}$, the reference voltage ($V_{RB}$) supplied to the differential amplifier A is determined by the bias voltage $V_{DD}$ of the buffer amplifier B. Conversely, the bias volta $V_{DD}$ of the buffer amplifier is supplied by the bias voltage supply means 500 comprising the array of the diodes $D_1$ and $D_2$, the resistors $R_3$ and $R_4$, and the transistor $Q_2$.

In accordance with the above construction, the base voltage of the transistor $Q_2$ can be varied in accordance with the variation of the input voltage ($V_{IN}$) supplied to the resistors $R_3$ and $R_4$, to thereby vary the bias voltage $V_{DD}$ of the buffer amplifier B in accordance with the variation of the input voltage ($V_{IN}$).

When the base voltage of the transistor $Q_2$ is represented as $V_B$ and the voltage of the diode D and the base-emitter voltage of the transistor $Q_2$ are represented as $V_D$, respectively, then the bias voltage $V_{DD}$ of the buffer amplifier B is represented by the following equation.

$$\begin{aligned} V_{DD} &= V_B - V_D = \frac{R_4}{R_3 + R_4}(V_{IN} - 2V_D) + V_D - V_D \\ &= \frac{R_4}{R_3 + R_4}(V_{IN} - 2V_D) \end{aligned} \tag{7}$$

From this equation, it will be understood that the bias voltage $V_{DD}$ is varied in accordance with the variation of the input voltage ($V_{IN}$).

Therefore, when the bias voltage $V_{DD}$ is varied in accordance with the variation of the input voltage ($V_{IN}$), the reference voltage ($V_{RB}$) supplied to the differential amplifier A is also varied in accordance with the input voltage ($V_{IN}$), and as a result, the output voltage ($V_0$) is varied in accordance with the variation of the input voltage ($V_{IN}$).

Figure 11:
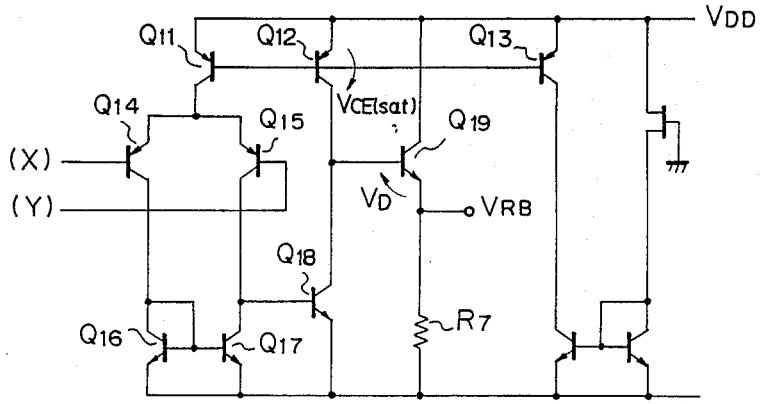
FIG. 11 is a detailed circuit diagram of the configuration of an embodiment of the buffer amplifier used in the circuit shown in FIG. 9B.

FIG. 11 is a detailed circuit diagram of the buffer amplifier B shown in FIG. 9B, in which the emitters of the transistors $Q_{14}$ and $Q_{15}$ are commonly connected and the commonly connected terminal thereof is connected to the collector of the transistor $Q_{11}$, which forms a constant current source circuit together with the transistors $Q_{12}$ and $Q_{13}$.

The reference voltage ($V_{RB}$) as shown in FIG. 9B is supplied to the base of the transistor $Q_{15}$ and the base of the transistor $Q_{14}$ is connected to the resistors $R_5$ and $R_6$. Further, the collectors of the transistors $Q_{14}$ and $Q_{15}$ are connected to the current mirror type transistor $Q_{16}$ and transistor $Q_{17}$, respectively, and the collector of the transistor is connected to the base of the transistor $Q_{18}$. The collector of the transistor $Q_{18}$ is connected to the emitter of the transistor $Q_2$ shown in FIG. 9B, through the transistor $Q_{12}$ providing the constant current loading circuit, and at the same time, the collector of the transistor $Q_{19}$ is connected to the emitter of the transistor $Q_2$ and the base thereof is connected to the collector of the transistor $Q_{18}$.

Finally, the emitter of the transistor $Q_{19}$ is connected to the earth through the resistor $R_7$, and the reference voltage ($V_{RB}$) supplied to the differential amplifier A is output from the emitter of the transistor $Q_{19}$.

In the buffer amplifier B of this embodiment, when the input voltage ($V_{IN}$) falls below the predetermined voltage $V_{IN(S)}$, the reference voltage $V_{RB}$) supplied to the differential amplifier A is represented by the following equation, in which the saturated voltage of the transistor $Q_{12}$ is $V_{CE(sat)}$.

$$V_{RB}=V_{DD}-\{V_D+V_{CE(sat)}\} \tag{8}$$

Therefore, the output volta $V_0$ is represented by the following equation $$V_0=\frac{R_1+R_2}{R_2}\times V_{RB}$$

The equation (5) can be changed as follows by substituting the equations (7) and (8) for the equation (9), $$\begin{aligned} V_0 &= \frac{R_1+R_2}{R_2}\times\{V_{DD}-V_D-V_{CE(sat)}\} \\ &= \frac{R_1+R_2}{R_2}\times \\ &\quad\left\{\frac{R_4}{R_3+R_4}(V_{IN}-2V_D)-V_D-V_{CE(sat)}\right\} \\ &= \frac{R_4(R_1+R_2)}{R_2(R_3+R_4)}\times V_{IN}- \\ &\quad\left\{\frac{R_3+3R_4}{R_3+R_4}\times V_D+V_{CE(sat)}\right\}\times\frac{R_1+R_2}{R_2} \end{aligned} \tag{10}$$

The difference of the voltage $V_a$ of the input voltage ($V_{IN}$) and the output voltage $V_0$ can be represented by the following equation.

$$V_a=V_{IN}-V_0=\left\{1-\frac{R_4(R_1+R_2)}{R_1(R_3+R_4)}\times V_{IN}+\right. \\ \left\{\frac{R_3+3R_4}{R_3+R_4}\times V_D+V_{CE(sat)}\right\}\times\frac{R_1+R_2}{R_2} \tag{11}$$

In the present invention, the transistor $Q_{12}$ is preferably designed such that it is always saturated when the operation is not stable and is not saturated when the operation is stable.

Therefore, when the input voltage ($V_{IN}$) is low when the operation is not stable, the transistor $Q_{12}$ is saturated, whereby the voltage value of $V_{DD}$ is directly supplied to the base of the transistor $Q_{19}$ through the transistor $Q_{12}$, and when the input voltage ($V_{IN}$) is low when the operation is stable, the transistor $Q_{12}$ is not saturated and acts as a normal operational amplifier, whereby $V_{RB}$ is obtained as shown in equation (4), and finally, the constant differential volta $V_a$ is obtained as shown in equation (11).

This difference of the voltage $V_a$ corresponds to the emitter-collector voltage $V_{CE}$ of the transistor $Q_1$.

In the present invention, the predetermined voltage $V_{IN(S)}$ can be set in accordance with the characteristic of the device, and the design thereof. Further, the value of the voltage $V_a$, i.e., the emitter-collector voltage of the output transistor means ($Q_1$), and the inclination of the characteristic curve of the constant voltage source circuit of the present invention, particularly when the operation is not stable, can be varied in accordance with the constant ratio defined by the resistors and capacitor used in this circuit.

Figure 12:
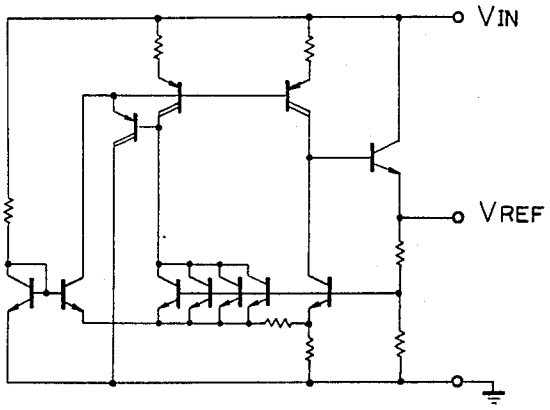
FIG. 12 shows an example of a circuit which can be used as a reference voltage source in the present invention.

Further, in the present invention, any kind of constant voltage supply means can be used as the reference voltage source, i.e. a Zener diode can be used, and further, for example, the circuit shown in FIG. 12 also can be used as the reference voltage source.

Figure 13:
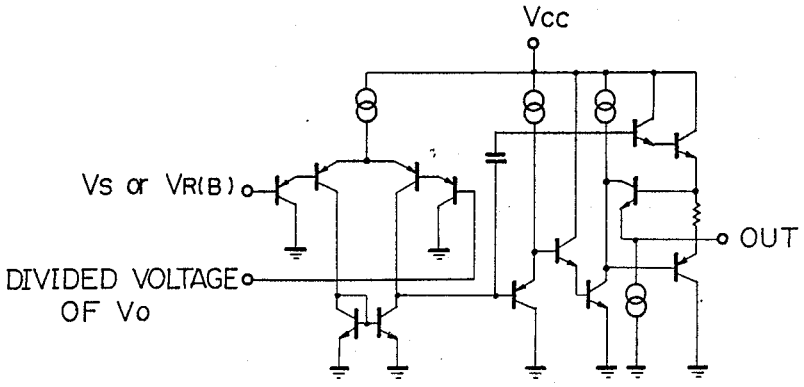
FIG. 13 shows an example of a circuit which can be used as a differential amplifier in the present invention.

The differential amplifier A used in the present invention may be any kind of operational amplifier but the operational amplifier shown in FIG. 13 is preferably used in this invention.

Figure 14:
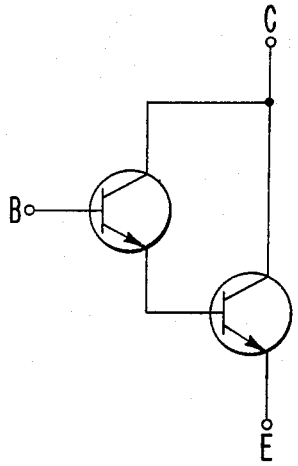
FIG. 14 is a circuit diagram of an embodiment of an output circuit of the present invention including a pair of Darlington connected transistors.
Figure 15:
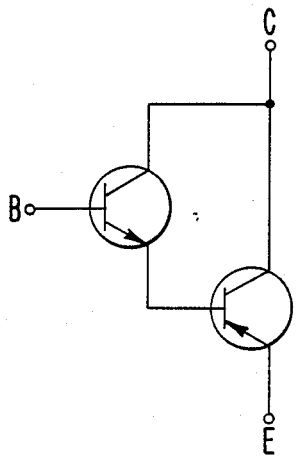
FIG. 15 is a circuit diagram of an embodiment of an output circuit of the present invention including a pair of inverted Darlington connected transistors.

In addition, the output transistor can include as the transistor $Q_1$, a pair of transistors having the same conductivity type and connected by a Darlington connection as shown in FIG. 14, or a pair of transistors having different conductivities and connected by a Darlington connection (referred to as an inverted Darlington connection) as shown in FIG. 15.

Therefore, according to the present invention, an adverse affect on the ripple rejection caused by the saturation of the transistor $Q_1$ is eliminated by setting the resistance value of the resistor $R_1$ and $R_2$ such that the difference of the voltage $V_a$ of the input voltage $V_{IN}$ and the output voltage $V_0$ is higher than the saturation voltage $V_{CE(sat)Q1}$ of the transistor $Q_1$ As explained above, in accordance with the present invention, when the input voltage ($V_{IN}$) is lowered and the constant voltage source circuit is forced to operate in a not stable condition, the deterioration of the ripple rejection thereof is prevented and thus the constant voltage source circuit of the present invention ensures a stable operation of the device.

We claim:

1. A constant voltage source circuit comprising:
   an input terminal for receiving an input voltage;
   an output transistor connected to said input terminal for outputting a predetermined output voltage in accordance with said input voltage;
   a differential amplifier for controlling said output transistor; and
   a reference voltage control means, operatively connected to said differential amplifier and said input terminal, for monitoring variations of said input voltage and for outputting a predetermined constant voltage to said differential amplifier as a reference voltage when said input voltage is higher than a predetermined voltage level, and outputting a voltage varied in accordance with the variation of said input voltage to said differential amplifier as the reference voltage when said input voltage falls below said predetermined voltage level.

2. A constant voltage source circuit according to claim 1, wherein said reference voltage control means further comprises a first reference voltage supply means for supplying said predetermined constant voltage to said differential amplifier (A) when said input voltage ($V_{IN}$) is higher than the predetermined voltage level and a second reference voltage supply means for supplying said voltage varied in accordance with the variation of said input voltage ($V_{IN}$) to said differential amplifier (A) when said input voltage ($V_{IN}$) falls below the predetermined voltage level.

3. A constant voltage source circuit according to claim 1, wherein said reference voltage control means further comprises a reference voltage supply means for supplying said predetermined constant voltage to said differential amplifier (A) when said input voltage ($V_{IN}$) is higher than the predetermined voltage level and a bias voltage supply means for supplying a bias voltage varied in accordance with the variation of said input voltage ($V_{IN}$) to said reference voltage supply means so as to provide said voltage ($V_{RB}$) varied in accordance with the variation of said bias voltage to said differential amplifier (A) when said input voltage ($V_{IN}$) falls below the predetermined voltage level.

4. A constant voltage source circuit according to claim 1, wherein said circuit further comprises a ripple elimination means for eliminating a ripple accumulated in said input voltage ($V_{IN}$).

5. A constant voltage source circuit according to claim 1, wherein said output transistor ($Q_1$) comprises a transistor.

6. A constant voltage source circuit according to claim 2, wherein said circuit further comprises a ripple elimination means for eliminating a ripple accumulated in said input voltage ($V_{IN}$).

7. A constant voltage source circuit according to claim 3, wherein said circuit further comprises a ripple.

8. A constant voltage source circuit according to claim 2, wherein said output transistor ($Q_1$) comprises a transistor.

9. A constant voltage source circuit according to claim 3, wherein said output transistor ($Q_1$) comprises a transistor.

10. A constant voltage source circuit according to claim 1, wherein said output transistor ($Q_1$) comprises a pair of transistors connected by a Darlington connection.

11. A constant voltage source circuit according to claim 1, wherein said output transistor ($Q_1$) comprises a pair of transistors connected by an inverted Darlington connection.

12. A constant voltage source circuit according to claim 2, wherein said output transistor ($Q_1$) comprises a pair of transistors connected by a Darlington connection.

13. A constant voltage source circuit according to claim 2, wherein said output transistor ($Q_1$) comprises a pair of transistors connected by an inverted Darlington connection.

14. A constant voltage source circuit according to claim 3, wherein said output transistor ($Q_1$) comprises a pair of transistors connected by a Darlington connection.

15. A constant voltage source circuit according to claim 3, wherein said output transistor ($Q_1$) comprises a pair of transistors connected by an inverted Darlington connection.

* * * * *

UNITED STATES PATENT AND TRADEMARK OFFICE

CERTIFICATE OF CORRECTION

PATENT NO. : 4,983,905

DATED : JANUARY 8, 1991

INVENTOR(S) : YOSHIAKI SANO ET AL.

It is certified that error appears in the above-identified patent and that said Letters Patent is hereby corrected as shown below:

Col. 1, line 43, "no" should be --not--.

Col. 5, line 59, "F($V_{IN}$)" should be --($V_{IN}$)--.

Col. 10, line 68, "transistor" should be --transistor $Q_{15}$--.

Col. 14, line 2, "ripple" should be --ripple elimination means for eliminating a ripple accumulated in said input voltage ($V_{IN}$).--.

Signed and Sealed this

Sixth Day of October, 1992

*Attest:*

DOUGLAS B. COMER

*Attesting Officer*

*Acting Commissioner of Patents and Trademarks*